US008827629B2

(12) United States Patent
Voleti et al.

(10) Patent No.: US 8,827,629 B2
(45) Date of Patent: Sep. 9, 2014

(54) CASE WITH BALLISTIC LINER

(75) Inventors: Sreenivasa R. Voleti, Farmington, CT (US); Darin S. Lussier, Berlin, CT (US); Rajiv A. Naik, Glastonbury, CT (US)

(73) Assignee: United Technologies Corporation, Hartford, CT (US)

( * ) Notice: Subject to any disclaimer, the term of this patent is extended or adjusted under 35 U.S.C. 154(b) by 642 days.

(21) Appl. No.: 13/024,386

(22) Filed: Feb. 10, 2011

(65) Prior Publication Data

US 2012/0207583 A1 Aug. 16, 2012

(51) Int. Cl.
*F01B 25/16* (2006.01)
*F01D 21/04* (2006.01)

(52) U.S. Cl.
CPC ..... *F01D 21/04* (2013.01)
USPC ..... 415/1; 415/9

(58) Field of Classification Search
USPC ..... 415/9, 170.1, 171.1, 173.1, 174.4, 220, 415/1; 60/39.091
See application file for complete search history.

(56) References Cited

U.S. PATENT DOCUMENTS

| | | | | | |
|---|---|---|---|---|---|
| 4,534,698 | A | * | 8/1985 | Tomich | 415/9 |
| 4,699,567 | A | * | 10/1987 | Stewart | 415/200 |
| 4,734,007 | A | * | 3/1988 | Perry | 415/9 |
| 5,160,248 | A | | 11/1992 | Clarke | |
| 5,344,280 | A | | 9/1994 | Langenbrunner et al. | |
| 5,409,349 | A | * | 4/1995 | Kulak et al. | 415/9 |
| 5,431,532 | A | | 7/1995 | Humke et al. | |
| 5,437,538 | A | * | 8/1995 | Mitchell | 415/9 |
| 5,482,429 | A | * | 1/1996 | Penda | 415/9 |
| 5,516,257 | A | * | 5/1996 | Kasprow et al. | 415/9 |
| 5,516,258 | A | * | 5/1996 | Newton | 415/9 |
| 5,823,739 | A | | 10/1998 | Van Duyn | |
| 5,876,651 | A | | 3/1999 | Blackburn, Jr. et al. | |
| 5,885,056 | A | * | 3/1999 | Goodwin | 415/9 |
| 6,059,524 | A | | 5/2000 | Costa et al. | |
| 6,146,089 | A | | 11/2000 | Allen et al. | |
| 6,371,721 | B1 | * | 4/2002 | Sathianathan et al. | 415/9 |
| 6,382,905 | B1 | | 5/2002 | Czachor et al. | |
| 6,394,746 | B1 | * | 5/2002 | Sathianathan et al. | 415/9 |
| 6,637,186 | B1 | | 10/2003 | Van Duyn | |
| 6,652,222 | B1 | | 11/2003 | Wojtyczka et al. | |
| 6,814,541 | B2 | | 11/2004 | Evans et al. | |
| 7,087,296 | B2 | | 8/2006 | Porter | |
| 7,246,990 | B2 | | 7/2007 | Xie et al. | |
| 2006/0260293 | A1 | * | 11/2006 | Launders | 60/226.1 |
| 2009/0067979 | A1 | | 3/2009 | Braley et al. | |
| 2009/0226310 | A1 | | 9/2009 | Finn et al. | |
| 2010/0111675 | A1 | * | 5/2010 | Wojtyczka et al. | 415/119 |

OTHER PUBLICATIONS

DuPont Launches Kevlar XP for Hard Armor Applications, http://www/prweb.com/releases/dupont/hard-armor-applications/prweb4682244.

* cited by examiner

*Primary Examiner* — Edward Look
*Assistant Examiner* — Aaron R Eastman
(74) *Attorney, Agent, or Firm* — Carlson, Gaskey & Olds, P.C.

(57) ABSTRACT

A fan case for a gas turbine engine includes an outer case defined about an engine axis and a hard ballistic liner defined about the engine axis, the hard ballistic liner within the outer case.

19 Claims, 2 Drawing Sheets

CASE WITH BALLISTIC LINER

BACKGROUND

The present disclosure relates to gas turbine engines, and in particular, to a fan case for a gas turbine engine.

The fan of a gas turbine engine includes an array of fan blades which project radially from a hub within a fan case. Although exceedingly unlikely, it is possible for a fan blade or a fragment thereof to separate from the hub and strike the fan case.

The demands of blade containment are balanced by the demands for low weight and high strength. For relatively small diameter engines, adequate containment capability is typically achieved with a hardwall design in which a metallic case thick enough to resist penetration by a blade fragment is utilized.

For relatively large diameter engines, a metallic case thick enough to resist penetration is prohibitively heavy. Therefore, a softwall design is utilized in which a light weight, high strength ballistic fabric such as KEVLAR (a registered trademark of E.I. DuPont de Nemours & Company) is wrapped in multiple layers around a relatively thin, penetration susceptible metallic case. In operation, a separated blade fragment penetrates the case and strikes the fabric. The metal case is punctured locally but retains its shape and structural integrity after impact. The punctured metal case continues to support the fabric and maintains the clearance between the blade tips and fan case.

SUMMARY

A case for a gas turbine engine according to an exemplary aspect of the present disclosure includes an outer case defined about an engine axis and a hard ballistic liner defined about the engine axis, the hard ballistic liner within the outer case.

A gas turbine engine according to an exemplary aspect of the present disclosure includes a fan section, a compressor section, a combustor section and a turbine section along an engine axis. An outer case is defined about a fan within the fan section and a hard ballistic liner is within the outer case.

A method of fan blade containment within a gas turbine engine according to an exemplary aspect of the present disclosure includes locating a hard ballistic liner within a composite outer case radially adjacent to an array of fan blades.

BRIEF DESCRIPTION OF THE DRAWINGS

Various features will become apparent to those skilled in the art from the following detailed description of the disclosed non-limiting embodiment. The drawings that accompany the detailed description can be briefly described as follows.

DETAILED DESCRIPTION

Figure 1:
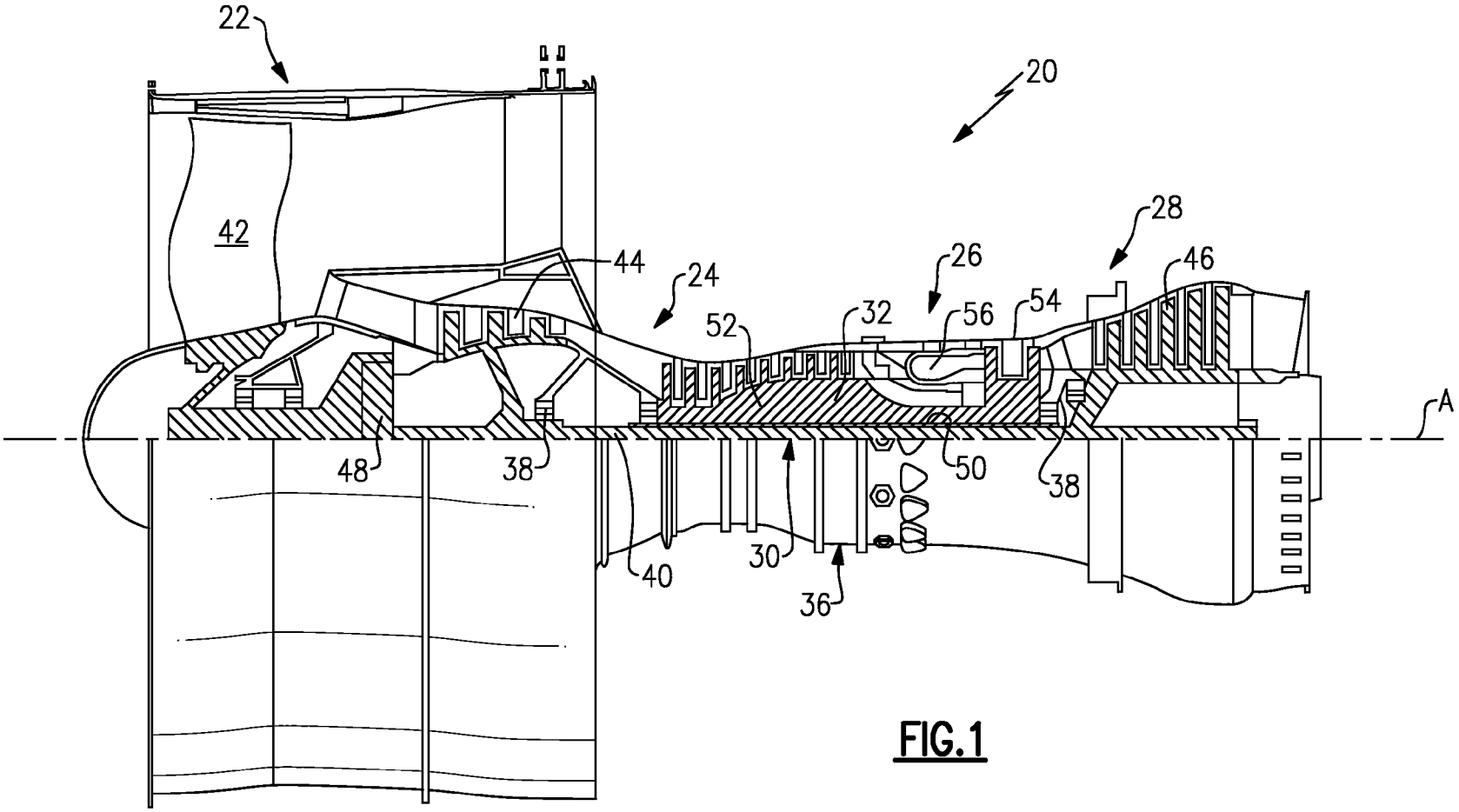
FIG. 1 is a schematic cross-sectional view of a gas turbine engine.

FIG. 1 schematically illustrates a gas turbine engine 20. The gas turbine engine 20 is disclosed herein as two-spool turbofan that generally incorporates a fan section 22, a compressor section 24, a combustor section 26 and a turbine section 28. Alternative engines might include an augmentor section (not shown) among other systems or features. The fan section 22 drives air along a bypass flowpath while the compressor section 24 drives air along a core flowpath for compression and communication into the combustor section. Although depicted as a two-spool, turbofan gas turbine engine in the disclosed non-limiting embodiment, it should be understood that the concepts described herein are not limited to use with two-spool or turbofan as the teachings can be applied to other turbine engine architectures or types.

The engine 20 generally includes a low speed spool 30 and a high speed spool 32 mounted for rotation about an engine central longitudinal axis A relative to an engine static structure 36 via several bearing systems 38. The low speed spool 30 generally includes an inner shaft 40 that interconnects a fan 42, a low pressure compressor 44 and a low pressure turbine 46. The inner shaft 40 may drive the fan 42 either directly or through a geared architecture 48 to drive the fan 42 at a lower speed than the low speed spool 30. The high speed spool 32 includes an outer shaft 50 that interconnects a high pressure compressor 52 and a high pressure turbine 54. A combustor 56 is arranged between the high pressure compressor 52 and the high pressure turbine 54. The inner shaft 40 and the outer shaft 50 are concentric and rotate about the engine central longitudinal axis A which is collinear with their longitudinal axes.

Core airflow is compressed by the low pressure compressor 44 then the high pressure compressor 52, mixed and burned with the fuel in the combustor 56, then expanded over the high pressure turbine 54 and low pressure turbine 46. The turbines 54, 46 rotationally drive the respective low speed spool 30 and high speed spool 32 in response to the expansion.

Figure 2:
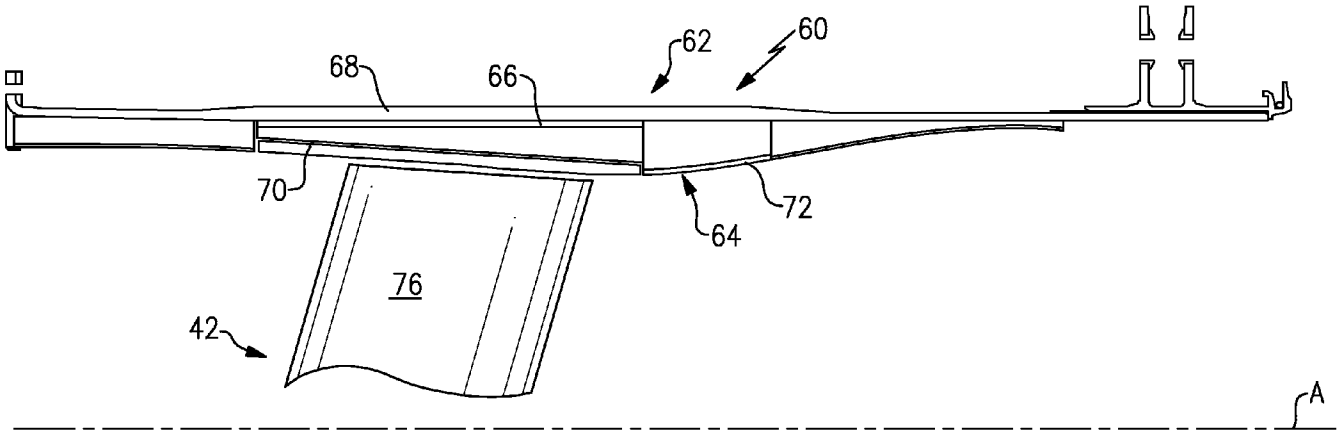
FIG. 2 is an enlarged cross-sectional view of a case section of the gas turbine engine which provides blade containment according to one non-limiting embodiment.

With reference to FIG. 2, the fan section 22 includes a case 60 that includes a fan blade containment assembly 62. The fan blade containment assembly 62 generally includes an inner structure 64, a hard ballistic liner 66, and an outer case 68 defined about the axis A.

The inner structure 64 may include an abradable layer 70 and a honeycomb structure 72. The abradable layer 70 provides close tolerances to be maintained between the fan blade tips and the inner structure 64. The honeycomb structure 72 provides acoustic dampening as well as the potential for retention of smaller blade fragments. It should be understood that the inner structure 64 is light weight and provides minimal, if any, resistance to blade fragment penetration.

The hard ballistic liner 66 is a cylindrical belt of a rigid material such as a resin impregnated KEVLAR® material such as KEVLAR® XP™ for Hard Armor (KEVLAR is a registered trademark of E.I. DuPont de Nemours & Company), LEXAN® (LEXAN is a registered trademark of SABIC Innovative Plastics), metallic structures, or ceramic materials. That is, the hard ballistic liner 66 operates as a rigid impact liner on the radially inner surface of the outer case 68 which may be manufactured of a composite material such as a carbon composite. The hard ballistic liner 66 need only extend a relatively short axial length as the hard ballistic liner 66 is radially located directly outboard of the fan blades 76 of the fan 42.

The hard ballistic liner 66 resists and dulls the ballistic threat which may be particularly acute when metallic fan blades 76 are utilized. The hard ballistic liner 66 provides a light weight approach to a hard wall containment system manufactured with composite materials to provide effective containment capability in a light weight configuration.

Figure 3:
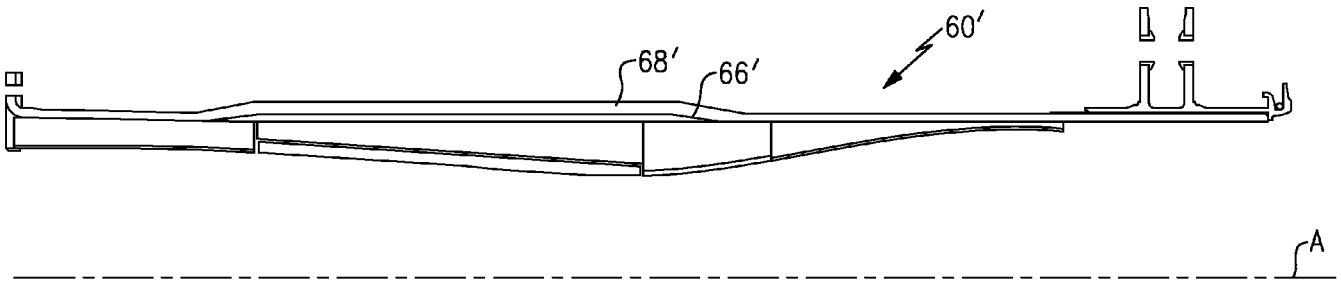
FIG. 3 is an enlarged cross-sectional view of a case section of the gas turbine engine which provides blade containment according to another non-limiting embodiment.

The hard ballistic liner 66 may be bonded to the inner surface of the outer case 68 as a secondary operation or co-molded therewith (FIG. 3). That is, the hard ballistic liner 66 may be molded directly into the composite outer case 68 (FIG. 3).

It should be understood that like reference numerals identify corresponding or similar elements throughout the several drawings. It should also be understood that although a particular component arrangement is disclosed in the illustrated embodiment, other arrangements will benefit herefrom.

Although particular step sequences are shown, described, and claimed, it should be understood that steps may be performed in any order, separated or combined unless otherwise indicated and will still benefit from the present invention.

The foregoing description is exemplary rather than defined by the limitations within. Various non-limiting embodiments are disclosed herein, however, one of ordinary skill in the art would recognize that various modifications and variations in light of the above teachings will fall within the scope of the appended claims. It is therefore to be understood that within the scope of the appended claims, the invention may be practiced other than as specifically described. For that reason the appended claims should be studied to determine true scope and content.

What is claimed:

1. A case for a gas turbine engine comprising:

an outer case defined about an engine axis, wherein said outer case is manufactured of a composite material;

a hard ballistic liner defined about the engine axis, the hard ballistic liner within said outer case;

an inner structure including a honeycomb layer extending along a radially innermost side of said case, wherein said honeycomb layer forms a boundary of a fan flow path and is axially spaced downstream of a trailing edge of a fan blade; and wherein a trailing edge of said hard ballistic liner is located axially upstream of a leading edge of said honeycomb layer.

2. The case for the gas turbine engine as recited in claim 1, wherein said hard ballistic liner is manufactured of a resin impregnated KEVLAR.

3. The case for the gas turbine engine as recited in claim 1, wherein said hard ballistic liner is manufactured of a ceramic material.

4. The case for the gas turbine engine as recited in claim 1, wherein said hard ballistic liner is manufactured of a metallic material.

5. The case for the gas turbine engine as recited in claim 1, wherein said hard ballistic liner is co-molded within said outer case.

6. The case for the gas turbine engine as recited in claim 1, wherein said hard ballistic liner is bonded to said outer case.

7. The case for the gas turbine engine as recited in claim 1, wherein said hard ballistic liner is cylindrical.

8. The case for the gas turbine engine as recited in claim 1, wherein said hard ballistic liner includes a first distal end and a second distal end and an inner surface of said hard ballistic liner extends generally parallel to an engine axis.

9. The case for the gas turbine engine as recited in claim 1 including an abradable layer of material, a trailing edge of said abradable layer is spaced axially upstream of a leading edge of said honeycomb layer.

10. A gas turbine engine comprising:

a fan section defined along an engine axis;

a compressor section downstream of said fan section along the engine axis;

a combustor section downstream of said compressor section along the engine axis;

a turbine section downstream of said combustor section along the engine axis;

an outer case defined about a fan within said fan section, wherein said outer case is manufactured of a composite material;

an inner structure located within said outer case including a honeycomb layer extending along a radially innermost side of a case, wherein said honeycomb layer forms a boundary of a fan flow path and is axially spaced downstream of a trailing edge of a fan blade;

a hard ballistic liner within said outer case; and wherein a trailing edge of said hard ballistic liner is located axially upstream of a leading edge of said honeycomb layer.

11. The gas turbine engine as recited in claim 10, wherein said hard ballistic liner is cylindrical.

12. The gas turbine engine as recited in claim 10, wherein said inner structure is located within said hard ballistic liner.

13. The gas turbine engine as recited in claim 12, wherein said inner structure defines an abradable material radially adjacent to an array of fan blades of said fan section.

14. The gas turbine engine as recited in claim 12, wherein said hard ballistic liner is a cylindrical member radially adjacent to an array of fan blades of said fan section.

15. The gas turbine engine as recited in claim 10, wherein said hard ballistic liner is spaced from said engine axis by a generally constant radial dimension.

16. The gas turbine engine as recited in claim 10, including an abradable layer of material, a trailing edge of the abradable layer is spaced axially upstream of a leading edge of said honeycomb layer.

17. A method of fan blade containment within a gas turbine engine comprising:

locating a hard ballistic liner within a composite outer case radially adjacent to an array of fan blades;

locating a honeycomb layer along a radially innermost side of a case, wherein said honeycomb layer forms a boundary of a fan flow path and is axially spaced downstream of a trailing edge of a fan blade; and wherein a trailing edge of said hard ballistic liner is located axially upstream of a leading edge of said honeycomb layer.

18. The method as recited in claim 17, further comprising co-molding the hard ballistic liner into the outer case.

19. The method as recited in claim 17, further comprising bonding the hard ballistic liner into the outer case.

* * * * *